US005781966A

United States Patent [19]

Ferrari et al.

[11] Patent Number: 5,781,966

[45] Date of Patent: Jul. 21, 1998

[54] CAM ADJUSTING DEVICE FOR FURNITURE

[75] Inventors: Franco Ferrari; Carlo Migli, both of Lecco, Italy

[73] Assignee: Franco Ferrari, Lecco, Italy

[21] Appl. No.: 797,008

[22] Filed: Feb. 7, 1997

[30] Foreign Application Priority Data

Feb. 14, 1996 [IT] Italy ..... MI96A0281

[51] Int. Cl.[6] ..... E05D 7/04

[52] U.S. Cl. ..... 16/242; 16/246; 16/335

[58] Field of Search ..... 16/245, 242, 243, 16/244, 246, 247, 248, 235–239, 362, 325, 296, 335, 284, 303; 408/173, 178; 411/273, 272

[56] References Cited

U.S. PATENT DOCUMENTS

| | | | |
|---|---|---|---|
| 3,336,962 | 8/1967 | Foote Jr., et al. | 411/272 |
| 4,339,493 | 7/1982 | MacIntyre | 16/243 |
| 4,680,830 | 7/1987 | Rock et al. | 16/246 |
| 4,691,408 | 9/1987 | Rock et al. | 16/246 |
| 5,307,539 | 5/1994 | Bauman | 16/239 |
| 5,607,271 | 3/1997 | Salice | 411/273 |

FOREIGN PATENT DOCUMENTS

| | | | |
|---|---|---|---|
| 21979 | 3/1930 | Australia | 411/272 |
| 561215 | 5/1944 | United Kingdom | 411/272 |

*Primary Examiner*—Chunck Mah

*Attorney, Agent, or Firm*—Shlesinger Fitzsimmons Shlesinger

[57] ABSTRACT

An cam adjusting device (30) comprises a first and second element sliding reciprocally and a cam (32) pivoted to the first element by means of a pivot (33) rotating around an axis (48) to react with one of its lateral surfaces (35, 38) against a bearing surface (34, 37) on the second element, upon rotation of the cam around the axis thereby achieving sliding and adjustment of the reciprocal position of the first and second element. The cam is shaped so that, for any angular position of the cam in its active stroke the centre of rotation of the cam is substantially in the region of a straight line (41) passing through a point (36) of contact between a lateral surface of the cam and a bearing surface of the second element, said straight line being slanted at an angle $\phi$ identical to the angle of friction in the point of contact. A cam meeting this condition has been found maximize the amplitude of the adjustment without encountering instability. Using cam adjusting device (30), iron fittings, such as hinges, are easy to make.

8 Claims, 2 Drawing Sheets

CAM ADJUSTING DEVICE FOR FURNITURE

BACKGROUND OF THE INVENTION

This invention refers to a cam adjusting device for iron fittings, such as hinges, drawer runners, supports for the front. panels of drawers, and similar elements comprising at least two parts whose reciprocable positions must be adjusted, and to the combination of iron fittings with such device.

In iron fittings for furniture, such as for example modern furniture hinges, it is important to be able to carry out the fine adjustment of the reciprocal position of the parts fastening the fitting, so as to be able to make up for any manufacturing and assembling tolerances and permit for the correct alignment of the furniture elements connected by means of the iron fitting.

For example, in the case of hinges, by providing a position adjustment of the two wings of the hinge the position of the doors can be finely adjusted with respect to the furniture unit and to the other adjacent doors. In the known technique, numerous adjusting devices applied to iron fittings for furniture have been proposed. For example, elements with adjustment provided by simple screws passing through sliding slots have been proposed. Such screw and slot adjustments present an intrinsic difficulty in adjustment, especially in the case of heavy parts, such as for example doors and the like, since the parts have to be manually picked up and held in the correct position until the screws have been fully tightened.

Cam adjustments have also been proposed, composed substantially of cams with two misaligned cylindrical surfaces, the first for rotation of the cam, the second for reaction on a thrust surface by the action of the part to be adjusted. Cam devices are theoretically simpler to adjust, but entail a common defect which could completely jeopardized their proper functioning. In fact, the known cam adjustments can prove to be unstable in the intermediate adjusting positions and consequently not operate correctly, especially whenever, as is often the case, extensive adjustment is required compared to the space available for positioning the cam. The instability consists in a tendency of the cam to spontaneously rotate towards dead-centre under the effect of the forces acting upon the iron fitting in its normal use. In order to prevent instability it is necessary to forgo the extent of the cam stroke and consequently cams with a relatively large diameter must be used. This solution is often incompatible with the limited spaces available in conventional iron fittings.

Moreover, cylindrical cams offer satisfactory adjustment only in a very limited central area of their rotation, thereby making it even more difficult to define the dimensions of the cam.

The general scope of this invention is to obviate the aforementioned problems by providing a cam adjusting device for iron fittings, such as hinges, runners or supports for the front panels of drawers, which has limited dimensions as compared to the extent of the adjustment provided, avoids phenomena of instability and. enables even and precise adjustment in any point of the adjusting stroke whatsoever.

A further scope is to provide iron fittings with such adjusting device.

SUMMARY OF THE INVENTION

This scope is achieved, according to the invention, by providing cam adjusting device comprising a first and second element sliding reciprocally and a cam pivoted to the first element by means of a pivot rotating around an axis to react with one of its lateral surfaces against a bearing surface on the second element, upon rotation of the cam around the axis thereby achieving sliding and adjustment of the reciprocal position of the first and second element, characterized by the fact that, for any angular position of the cam in its active stroke around said axis of rotation the centre of rotation of the cam is substantially in the region of a straight line passing through a point of contact between a lateral surface of the cam and a bearing surface of the second element, said straight line being slanted at an angle $\phi$ identical to the angle of friction in the point of contact.

BRIEF DESCRIPTION OF THE DRAWINGS

The innovative principles of this invention and its advantages with respect to the known technique will be more clearly evident from the following description of a possible exemplificative embodiment applying such principles, with reference to the accompanying drawings, in which.

DETAILED DESCRIPTION OF THE INVENTION

Figure 1:
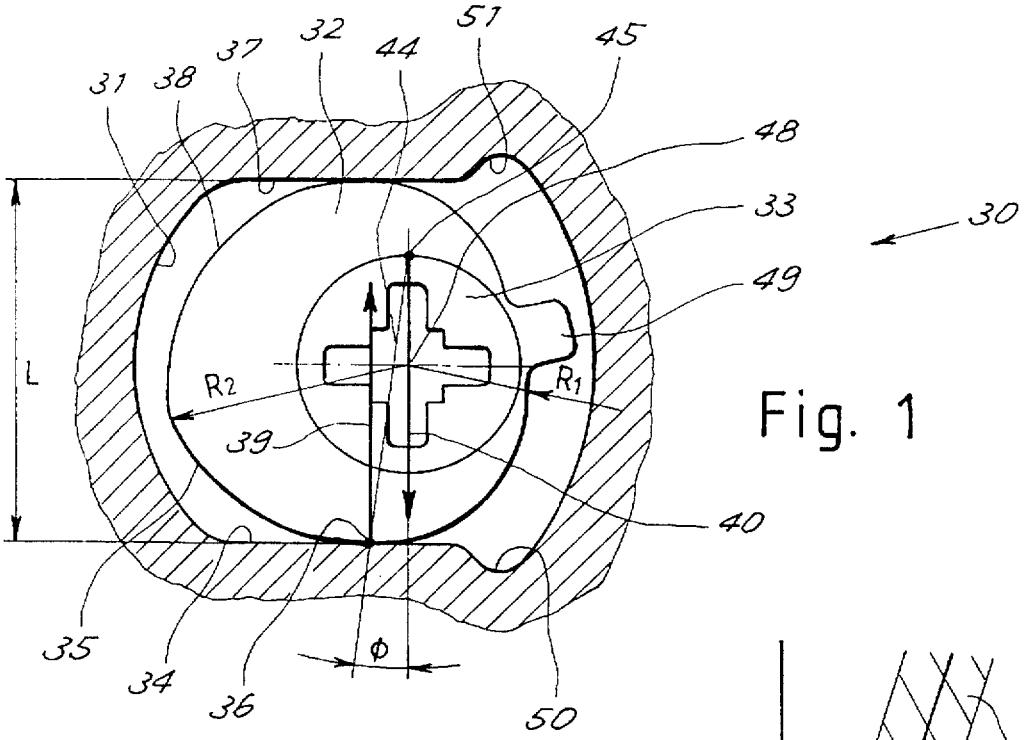
FIG. 1 shows a schematic view of a cam adjusting device made according to the invention.

With reference to the figures, FIG. 1 schematically shows a cam adjusting device, generically indicated by 30, for adjusting the position between a first part, having therein a slot or housing 31 containing a cam 32, and a second part for housing (not shown) for rotation therein of a cylindrical pivot 33 controlling rotation of the cam 32.

The housing 31 comprises an internal lateral surface 34 against which reacts a corresponding lateral surface 35 of the cam 32. The surface 34 of the housing has a substantially rectilinear section tangent to the point of support 36 upon it on which the surface 35 of the cam rests. A second internal lateral surface 37 of the housing is disposed facing the surface 34 of the housing so as to have a rectilinear section substantially parallel to the rectilinear section of the first surface and to constitute a support for a second lateral surface 38 of the cam. As will be clear from the examples described further on, the housing of the pivot is obliged to move in a direction perpendicular to the planes 34 and 37.

Upon rotation of the cam around the axis 48 of the pivot, the axis itself oscillates between an upper position of maximum distance from the lower wall 34 of the housing (reached when the cam has its maximum radius R2 in point 36) and a lower position of minimum distance from it (reached when the cam has its minimum radius R1 in point 36). In FIG. 1, the cam is represented in an intermediate position. Acting on the cam are a force of action, indicated by the arrow 39, applied in the point 36 of contact between the body of the cam and the lower wall of the housing, and an identical and opposing force of reaction, indicated by the arrow 40, which acts between the pivot 33 and its housing and which can be considered as passing through the centre of the pivot.

In the known cam adjusting devices, for example comprising a cylindrical cam body, the lines of application of the forces of action and reaction coincide when the cam is in one of the extreme upper or lower positions, while they are misaligned in the intermediate positions. In this situation, the two forces generate a torque which tends to rotate the eccentric towards the dead centre. The friction between the cam and its housing and between the pivot and its housing contrast said torque, but in some conditions the torque can become excessive and the cam rotates spontaneously towards the dead centre.

The most disadvantageous condition is when the cam is half way through the adjustment, since in this situation the misalignment between the forces of action and reaction is at its maximum. Consequently, in order to prevent spontaneous rotation it is necessary to ensure that in this position the torque does not exceed the maximum value beyond which spontaneous rotation occurs. This, however, sets a limit to the maximum adjustment possible for a cylindrical cam in relation to its size.

This is the main reason why the problem is even more serious whenever considerable adjustments are required compared to the space available for housing the eccentric.

According to the innovative principles of this invention, it has been found that if the centre of rotation of the cam moves along a particular straight line or sheaf of straight lines instead of, for example, along an arc of a circumference as occurs for the cylindrical cams, it is possible to maximize the amplitude of the adjustment without encountering instability.

Figure 2:
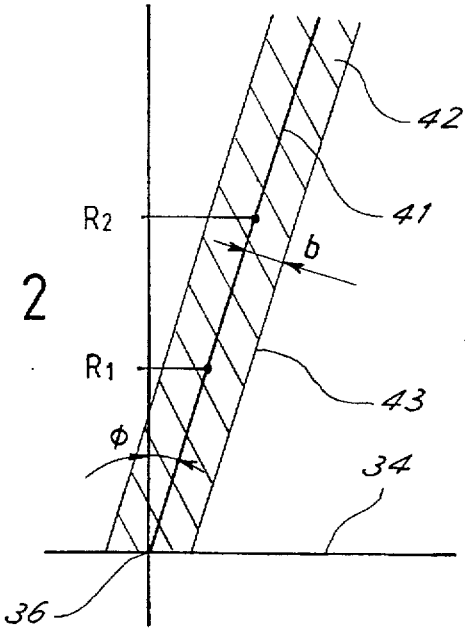
FIG. 2 shows a graph illustrating a condition that the centre of rotation of the cam must fulfill according to the invention.

FIG. 2 shows a graph which explains this. The horizontal axis coincides with the surface 34 tangent to the surface of the cam. The vertical axis represents the perpendicular at the tangent point 36. The straight line 41 is the line of friction, that is to say the line which crosses through the tangent point 36 and is slanted by an angle $\phi$ with respect to the perpendicular, where $\phi$ is the traditional angle of sliding friction between the cam and the bearing surface.

According to the invention, in any angular position of the cam along its active stroke, the centre of rotation of the cam must be substantially in the region of the line of friction as defined above. In other words, the centre of rotation of the cam must lie or a parallel line within a strip 42 containing the line of friction 41.

The best possible condition is when the centre of rotation is situated constantly on a boundary line 43, parallel to the line of friction and at a distance from it by a value $b=r*fp*\cos\phi$, where r is the radius of the pivot 33 and fp is the friction coefficient of the contact between the pivot and its housing. The best possible condition is understood to mean the condition in which the maximum possible amplitude of the adjustment is achieved without any point of instability in the active stroke of the cam. Moreover, the raising of the pivot will be substantially proportional to the angle of rotation of the cam and consequently uniform adjustment will be achieved along the entire active stroke of the cam.

In the particular case of identical friction coefficients between the cam and its housing and between the pivot and its housing, that is to say when $fp=\tan\phi$, then $b=r*\mathrm{sen}\phi$. This means that the cam must be shaped in such a way that, as shown in FIG. 1, a segment 44 crossing through the tangent point 36 and the point 45 of the pivot which is furthest away from the surface 34 is slanted by the angle $\phi$ with respect to the perpendicular to the surface 34. In other words, the best possible condition is achieved when, for any angle of rotation of the cam within its active stroke, the point 45 is situated on the line of friction 41. This makes tracing out the cam by points particularly easy.

In the case of a cam which, as shown in FIG. 1, rotates between two surfaces 34 and 37, by calculating the cam portion 35 which slides over the surface 34 so as to fulfill the rule indicated above, the cam portion 38 which slides over the surface 37 can be easily calculated by simply ensuring that the distance L between the surfaces 37 and 34 remains constant in the tangent points with the cam.

Figure 3:
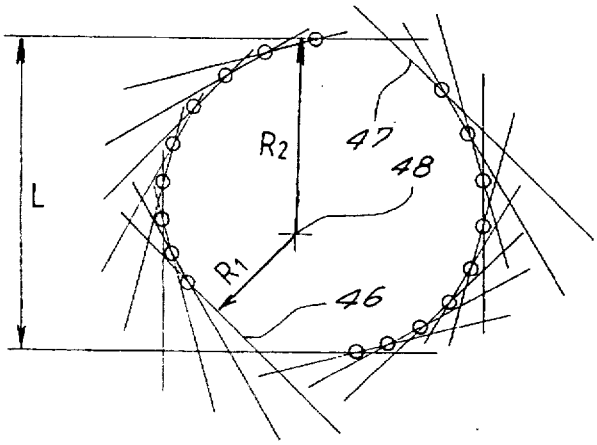
FIG. 3 shows a construction by points of a cam according to the invention.

A cam with an active profile 35 according to the invention can be identified reasonably accurately, disregarding the radius of the pivot, by the envelope of straight lines distant from the centre of rotation of the cam by a distance $Dn=Dn-1*\alpha p*\tan\alpha$, with Dn identical to the distance from the centre of the nth line, Dn−1 identical to the distance of the previous line to the nth line from the centre of the cam, $\alpha P$ identical to the angular pitch of calculation of the cam (that is to say: $\alpha P$ identical to the angle between the line n and the line n−1), $\alpha$ identical to the angle of inclination (in radians) between the tangent to the cam and the perpendicular to the line joining the tangent point to the centre of the cam. The angle $\alpha$ must be smaller than the angle of friction $\phi$ between the cam and its housing. In particular, for the best possible condition $\alpha=\phi$. The envelope of straight lines on the other profile 38 of the cam is obtained by tracing the parallel lines at a distance L from the lines of the first envelope, FIG. 3 shows the overall envelope. Said envelope can be advantageously developed by an automatic calculation program.

With reference to FIG. 3, the first step in calculating the profile consists in tracing a straight line 46 at a distance Do from the axis 48 of rotation of the cam, corresponding to R1, that is to say at the minimum distance foreseen between the axis of rotation and one of the two walls of the housing bearing the cam. It is obvious that the profile can be traced by taking the distance from the lower wall or from the upper wall of the housing. From the opposite part with respect to the axis of rotation, a straight line 47 is then traced, parallel to the line 46 and at a distance L from it. The lines traced are then made to rotate by the angle $\alpha P$ around the centre of rotation 48 of the cam. The new distance $D1=Do*\alpha P*\tan\alpha$ is then calculated and the corresponding line rotated by the angle $\alpha P$ with respect to the previous line and the parallel line at distance L are traced. The construction of the envelope proceeds repeatedly in this way until it is observed that $Dn>=R2$, that is, until the desired amplitude of adjustment is achieved. This must obviously occur before a 180° profile is traced. It is clear that to ensure better precision in the determination of the cam profile it is necessary for the angle $\alpha P$ to be chosen sufficiently small.

At this point it is evident how a cam adjusting device according to the invention is achieved. The vicinity of the centre of the cam to the outermost line 43 obviously depends upon the tolerances used in constructing the device. In fact, it must be considered that going outside the strip 42 beyond the line 43 leads to the onset of instability in the adjustment. In general, it is consequently preferable to maintain the centre of rotation slightly more within the strip 42 along the entire adjustment stroke. As can be seen in FIG. 1, in addition to the active profile as described above, it is advantageous for the cam to have a radially protruding shank 49 to constitute a limit stop to the rotation of the cam by its engagement in recesses 50, 51 in the housing 31.

Embodiments of iron fittings for furniture apply the device according to the invention will be describe.

Figure 4:
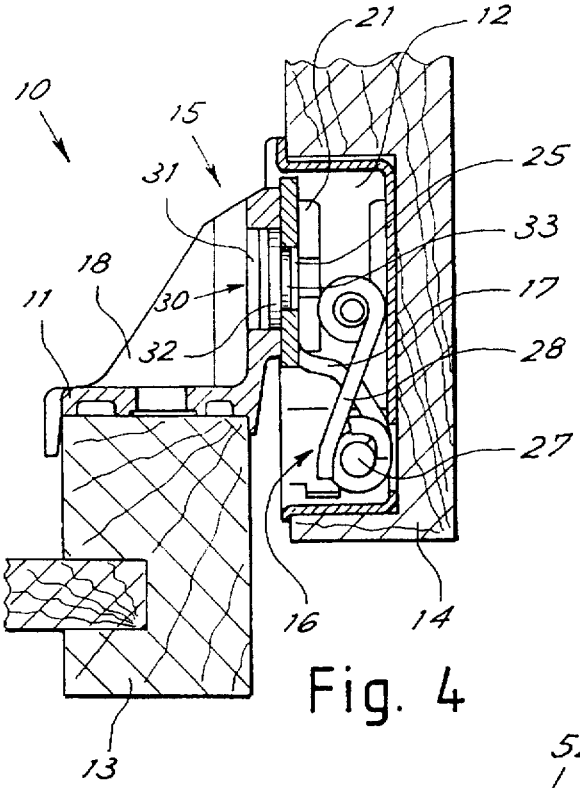
FIG. 4 shows a side elevation view, partially cutaway, of a furniture hinge shown in FIG. 5, which is provided with the cam adjusting device according to the invention.
Figure 5:
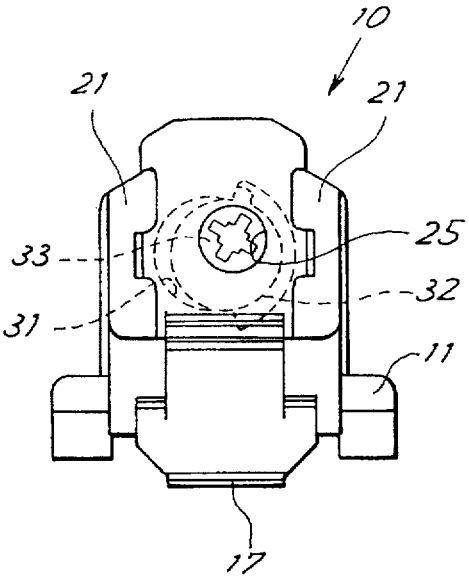
FIG. 5 shows a front view of the hinge of FIG. 4.

FIGS. 4 and 5 show a first furniture hinge, generically indicated by 10, made according to the innovative principles as claimed. The hinge 10 comprises a first and second fastening element, respectively indicated by 11 and 12, designed to be secured to two furniture parts 13, 14, for example a side panel and the respective door, to be hinged together.

The hinge comprises an arm 15 which ends at one extremity with the first fastening element 11 and at the other extremity with a pivot 16 pivoting it to the second fastening element to achieve the joint of the hinge. The arm 15 is composed of two reciprocally sliding parts 17, 18. The first part 17 comprises the pivot 16 securing it to the second fastening element 12 and the second part 18 is L-shaped, one arm of the L forming the first fastening element 11 and the other arm of the L forming the sliding surface for the first part 17. The sliding is guided by lateral edges 21 which form a guide channel which slidingly receives the sliding wing of the first part 17.

The second fastening element 12 is advantageously made in the form of a cup or box recessed so as to contain the pivot, made with a single pin 27 around which the pivoting end of part 17 is wound.

A spring 28 reacts between the cup and the pivot to define stable open and closed positions.

As can also be clearly seen in FIG. 5, where the cup has been removed for greater clarity, disposed between the first and second part are cam adjusting means 30, made according to the invention, comprising a cam 32, of the type shown in FIG. 1., pivoted, by means of a pivot 33 received in a housing 25, to part 17 so as to react against lateral surfaces or a housing 31 in part 18. As can be clearly seen in FIG. 5, the pivot has an upper end which faces out from the first part 17 to constitute the operating end (for example, by means of a screwdriver) of the cam. Upon rotation of the cam, part 17 slides with respect to part 18, thereby providing precise and stable lateral adjustment of the position of the door.

Figure 6:
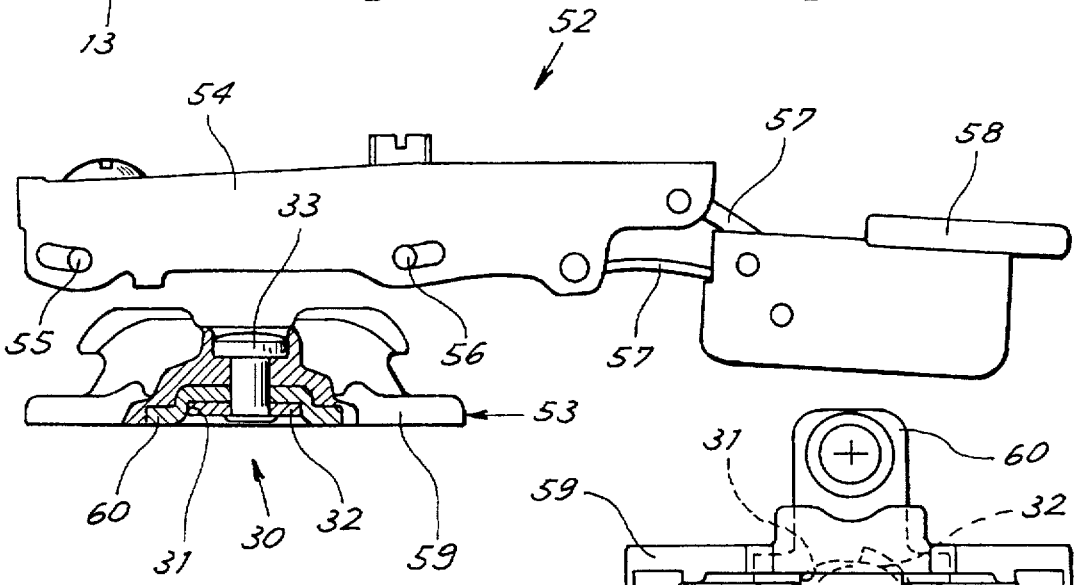
FIG. 6 shows an exploded and partially cutaway view of a second furniture hinge having a cam adjusting device according to the invention.
Figure 7:
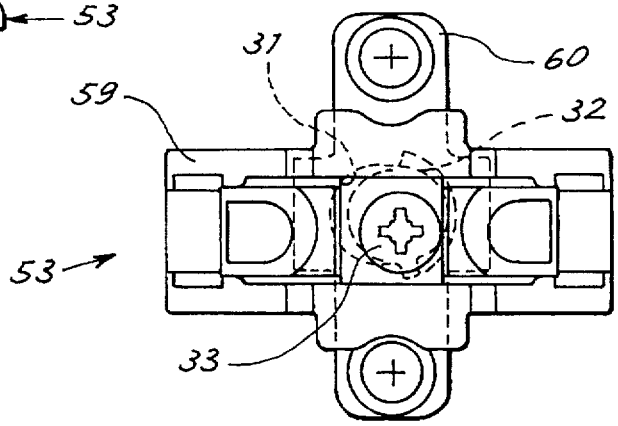
FIG. 7 shows a front view of part of the hinge of the FIG. 6.

FIGS. 6 and 7 show scrap views of a second furniture hinge, generically indicated by reference 52, which comprises a base 53, designed to be secured to a side panel of a furniture unit, and a wing 54 which snap fits onto the base 53 by means of spring pins 55, 56. The wing 45 supports articulating arms 57 which are connected to a cup-shaped fastening element 58 designed to be secured to a door to be hinged.

Up to this point, a substantially known hinge has been described and will therefore not be further described or illustrated. As can be clearly seen also in FIG. 7, the base 53 is composed of a first upper element 59 which fits into the wing, and a second element or plate 60 which is secured to the furniture unit. The first and second elements slide reciprocally in a crosswise direction to the length of the wing. Disposed between the first and second element is a cam adjusting device 30 made according to the invention, with a slot 31 punched in the plate 60 and a cam 32 received therein. The pivot 33 for rotation of the cam protrudes upwards from the base 53 to enable it to be adjusted through a hole, not shown, in the wing. By means of the adjusting device it is thus possible to translate the wing 54 crosswise with respect to the base plate 60 and thereby obtain a precise vertical adjustment of the door with respect to the rest of the furniture unit.

At this point, the use of the device according to the invention to obtain iron fittings for furniture is clear. The foregoing description of an embodiment applying the innovative principles of this invention is obviously given by way of example in order to illustrate such innovative principles and should not therefore be understood as a limitation to the sphere of the invention claimed herein. For example, the adjusting device can be inserted into other iron fittings for furniture, such as runners for drawers or the like.

What is claimed is:

1. Cam adjusting device for furniture fittings, comprising first and second elements slidable reciprocally relative to each other, and a cam pivtoally connected to the first element by means of a pivot for rotating the cam around an axis to react a lateral surface on said cam against a bearing surface on the second element, upon rotation of the cam around the axis thereby achieving sliding adjustment of the reciprocal positions of the first and second elements, characterized by the fact that, for any angular position of the cam around said axis of rotation, the centre of rotation of the cam is on a line coincident with or parallel to a straight line passing through the point of contact of said lateral surface of the cam with said bearing surface on the second element, said straight line being inclined at an angle $\phi$ to a line perpendicular to the point of tangency between said lateral surface on said cam and said bearing surface on said second element.

2. Device as claimed in claim 1, characterized by the fact that the centre of rotation of said cam is no further than $r*fp*\cos\phi$ from said straight line, with r being identical to the radius of the pivot and fp being identical to the coefficient of friction between the pivot and its housing.

3. Device as claimed in claim 1, characterized by the fact that the centre of rotation is no further than $r*\mathrm{sen}\phi$ from said straight line, with r being identical to the radius of the pivot.

4. Device as claimed in claim 1, characterized by the fact that the bearing surface forms part of a housing to laterally receive the cam which comprises a second surface of contact with the cam, opposite the first surface, said first and second surfaces being parallel with each other in the respective points of contact with the cam.

5. Device as claimed in claim 3, characterized by the fact that, for any angle of rotation of the cam, the point on the surface of the pivot which is furthermost from the bearing surface lies substantially close to said straight line.

6. Device as claimed in claim 1, characterized by the fact that the cam is defined by an envelope of straight lines spaced apart from the axis of rotation of the cam by a distance $Dn=Dn-1*\alpha p*\tan\alpha$, with Dn identical to the distance between axis of rotation and nth straight line, Dn−1 identical to the distance between straight line preceding the nth straight line and axis, $\alpha P$ identical to the angle between the straight line n and the straight line n−1, $\alpha$ being an angle smaller or identical to the angle of friction $\phi$.

7. Device as claimed in claim 1, characterized by the fact that the first element is integral with a first portion of an iron fitting element designed to be secured to a first furniture part, and the second element is integral with a second portion of an iron fitting element designed to be secured to a second furniture part to permit adjustment of the reciprocal position of the first and second furniture parts.

8. A furniture hinge comprising first and second fastening elements, said fastening elements being designed to be secured to two furniture components to be hinged together, and a hinging means disposed between the first and the second fastening elements to form the articulation of the hinge, one of said fastening elements being divided into first and second parts adjustably and reciprocally connected together with means for adjusting the reciprocal positions thereof, and characterized by the fact that said first part is integral with said first element and said second part is integral with said second element of a cam adjusting device made according to any one of the previous claims 1 to 7, thereby to form the means of adjusting the reciprocal positions of said parts.

* * * * *